US011335201B2

(12) United States Patent
Sakakibara et al.

(10) Patent No.: US 11,335,201 B2
(45) Date of Patent: May 17, 2022

(54) PASSAGE POSSIBILITY DETERMINATION APPARATUS, PASSAGE POSSIBILITY DETERMINATION METHOD, AND COMPUTER PROGRAM

(71) Applicant: SUMITOMO ELECTRIC INDUSTRIES, LTD., Osaka (JP)

(72) Inventors: Hajime Sakakibara, Osaka (JP); Arata Doi, Osaka (JP); Hiroshi Matsumoto, Osaka (JP); Nobuhiro Yamazaki, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/970,985

(22) PCT Filed: Dec. 27, 2018

(86) PCT No.: PCT/JP2018/048043
§ 371 (c)(1),
(2) Date: Aug. 19, 2020

(87) PCT Pub. No.: WO2019/163287
PCT Pub. Date: Aug. 29, 2019

(65) Prior Publication Data

US 2020/0402406 A1 Dec. 24, 2020

(30) Foreign Application Priority Data

Feb. 23, 2018 (JP) ..... JP2018-030917

(51) Int. Cl.
*G08G 1/00* (2006.01)
*G08G 1/01* (2006.01)
(Continued)

(52) U.S. Cl.
CPC ..... *G08G 1/22* (2013.01); *G08G 1/0137* (2013.01); *G08G 1/095* (2013.01); *G08G 1/096791* (2013.01)

(58) Field of Classification Search
CPC ..... G08G 1/22; G08G 1/0137; G08G 1/095; G08G 1/096791
See application file for complete search history.

(56) References Cited

U.S. PATENT DOCUMENTS 8,417,860 B2 * 4/2013 Choi ..... H04L 67/12 710/100
9,616,743 B1 * 4/2017 Mays ..... B60W 10/30
(Continued)

FOREIGN PATENT DOCUMENTS

CN 107146423 A 9/2017
JP H08-106596 A 4/1996
(Continued)

*Primary Examiner* — Hussein Elchanti
(74) *Attorney, Agent, or Firm* — Faegre Drinker Biddle & Reath LLP

(57) ABSTRACT

An apparatus according to one aspect of the present invention determines whether or not platoon vehicles can pass through an intersection, and includes: a calculation unit that calculates a first distance, a second distance, and a third distance described below; and a determination unit that determines whether or not the platoon vehicles can pass through the intersection, based on a result of comparison of the first distance with the second and third distances. First distance: a distance from a stop line of the intersection to a position of a leading vehicle at the present time. Second distance: a distance obtained by subtracting a platoon length from a distance of traveling for a remaining green interval at a vehicle speed at the present time. Third distance: a distance required for the leading vehicle to safely stop before the stop line of the intersection, with the vehicle speed at the present time.

10 Claims, 9 Drawing Sheets

(51) Int. Cl.
*G08G 1/095* (2006.01)
*G08G 1/0967* (2006.01)

(56) References Cited

U.S. PATENT DOCUMENTS

| | | | | |
|---|---|---|---|---|
| 9,725,083 | B2 * | 8/2017 | Dextreit | B60W 20/40 |
| 2006/0155427 | A1 * | 7/2006 | Yang | G08G 1/081 701/1 |
| 2007/0030212 | A1 * | 2/2007 | Shibata | G08G 1/162 345/9 |
| 2010/0117861 | A1 * | 5/2010 | Free | G08G 1/07 340/929 |
| 2010/0256852 | A1 * | 10/2010 | Mudalige | G08G 1/22 701/24 |
| 2011/0068950 | A1 * | 3/2011 | Flaherty | G08G 1/096 340/905 |
| 2014/0095058 | A1 * | 4/2014 | Patel | G08G 1/00 701/117 |
| 2014/0236414 | A1 * | 8/2014 | Droz | G08G 1/166 701/28 |
| 2016/0163200 | A1 * | 6/2016 | He | G08G 1/22 701/117 |
| 2017/0036601 | A1 * | 2/2017 | Kimura | B60R 1/00 |
| 2017/0270785 | A1 | 9/2017 | Umehara | |
| 2018/0188745 | A1 * | 7/2018 | Pilkington | G05D 1/0276 |

FOREIGN PATENT DOCUMENTS

| | | | |
|---|---|---|---|
| JP | 2009-048406 | A | 3/2009 |
| JP | 2014-191728 | A | 10/2014 |
| JP | 2016-115123 | A | 6/2016 |
| JP | 2018-077761 | A | 5/2018 |

* cited by examiner

When G=20 X ≦ Ld →Pass
When G=5 Ld < X →Stop $X \leqq L_{d(Y)}$ Pass by Yellow $L_{d(Y)} < X$ Stop

[EXTENSION POSSIBILITY DETERMINATION PROCESS]

[PASSAGE POSSIBILITY DETERMINATION PROCESS]

PASSAGE POSSIBILITY DETERMINATION APPARATUS, PASSAGE POSSIBILITY DETERMINATION METHOD, AND COMPUTER PROGRAM

TECHNICAL FIELD

The present invention relates to a passage possibility determination apparatus, a passage possibility determination method, and a computer program for determining whether or not platoon vehicles can pass through an intersection.

This application claims priority on Japanese Patent Application No. 2018-030917 filed on Feb. 23, 2018, the entire contents of which are incorporated herein by reference.

BACKGROUND ART

Patent Literature 1 discloses a traffic signal control apparatus including: an acquisition unit that acquires positional information of a leading vehicle in a vehicle group consisting of a plurality of public vehicles traveling in platoon, and the length of the vehicle group; and a control unit capable of executing, based on the acquired information, preferential control for vehicle group which is preferential control for the entirety of the public vehicles forming the vehicle group.

The traffic signal control apparatus disclosed in Patent Literature 1 is capable of performing the preferential control that allows the vehicle group consisting of the plurality of public vehicles to preferentially pass through the intersection without dividing the vehicle group.

CITATION LIST

Patent Literature

PATENT LITERATURE 1: Japanese Laid-Open Patent Publication No. 2016-115123

SUMMARY OF INVENTION (1) An apparatus according to one aspect of the present disclosure is an apparatus configured to determine whether or not platoon vehicles can pass through an intersection, and the apparatus includes: a calculation unit configured to calculate a first distance, a second distance, and a third distance described below; and a determination unit configured to determine whether or not the platoon vehicles can pass through the intersection, based on a result of comparison of the first distance with the second and third distances.

First distance: a distance from a stop line of the intersection to a position of a leading vehicle at the present time.

Second distance: a distance obtained by subtracting a platoon length from a distance of traveling for a remaining green interval at a vehicle speed at the present time.

Third distance: a distance required for the leading vehicle to safely stop before the stop line of the intersection, with the vehicle speed at the present time.

(9) A method according to one aspect of the present disclosure is a method for determining whether or not platoon vehicles can pass through an intersection, and the method includes: calculating the first distance, the second distance, and the third distance described above; and determining whether or not the platoon vehicles can pass through the intersection, based on a result of comparison of the first distance with the second and third distances.

(10) A computer program according to one aspect of the present disclosure is a computer program configured to cause a computer to function as an apparatus for determining whether or not platoon vehicles can pass through an intersection, and the computer program causes the computer to function as: a calculation unit configured to calculate the first distance, the second distance, and the third distance described above; and a determination unit configured to determine whether or not the platoon vehicles can pass through the intersection, based on a result of comparison of the first distance with the second and third distances.

DESCRIPTION OF EMBODIMENTS

Figure 1:
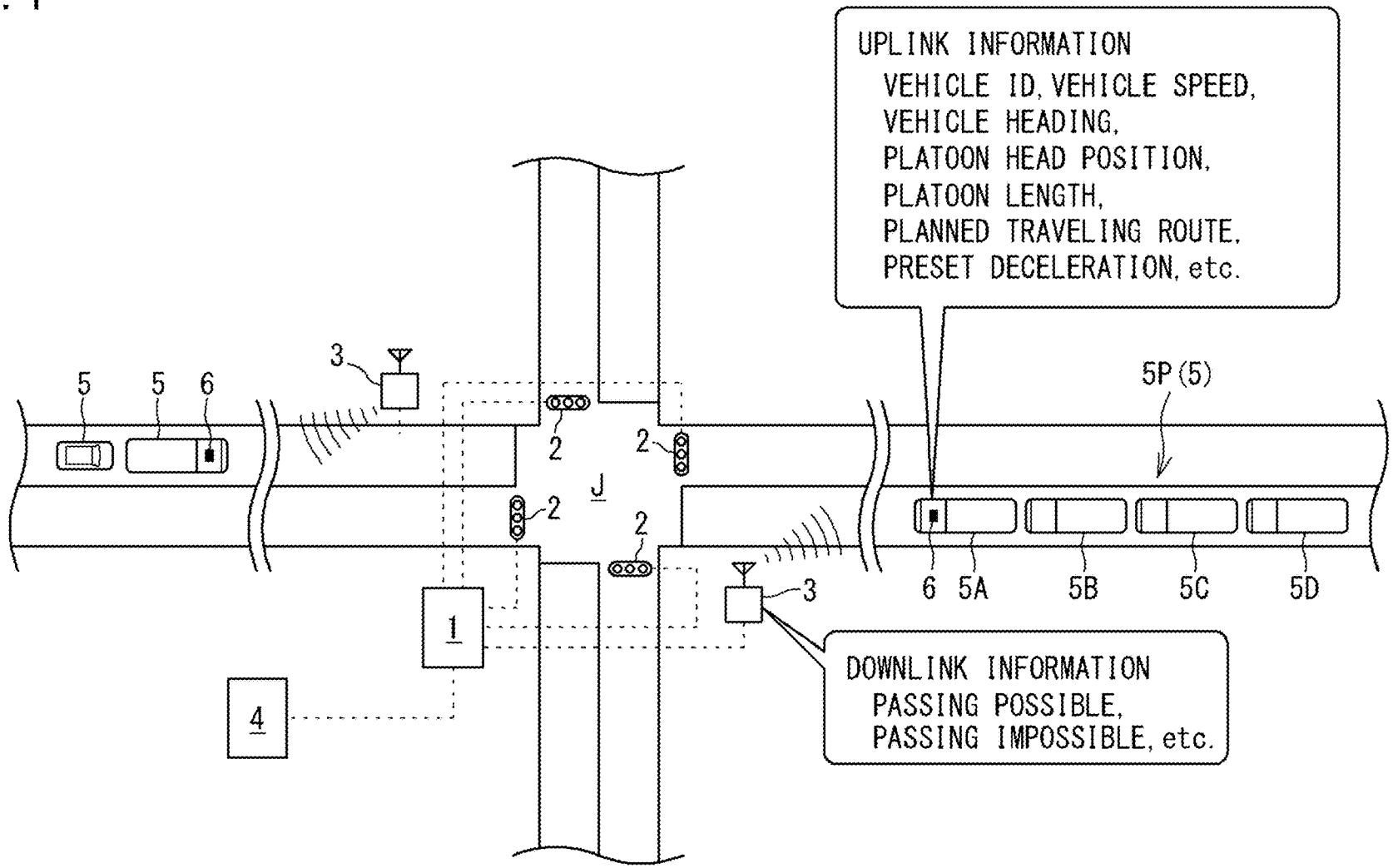
FIG. 1 is a road plan view showing an entire configuration of a traffic signal control system.

Problems to be Solved by the Present Disclosure

In Patent Literature 1, whether or not a tail-end vehicle among a plurality of vehicles traveling in platoon (hereinafter referred to as "platoon vehicles") can pass through an intersection is determined based on the position of the tail-end vehicle at the present time, a remaining green interval, and the vehicle speed. Based on the determination result, whether or not to extend the green interval is determined.

However, for example, when the time point to determine extension of the green interval is just before a yellow interval and the leading vehicle is present near a safe stop distance, the leading vehicle just comes to a so-called dilemma zone. Therefore, even if the remaining green interval is extended, the driver of the leading vehicle is likely to stop the platoon vehicles.

Therefore, it is desired to provide a method for appropriately determining not only whether or not the tail-end vehicle can pass through the intersection but also whether or not the platoon vehicles can pass through the intersection while considering the positional relationship between the leading vehicle and the safe stop distance.

An object of the present disclosure is to provide a passage possibility determination apparatus capable of appropriately determining whether or not platoon vehicles can pass through an intersection.

Effects of the Present Disclosure

According to the present disclosure, it is possible to appropriately determine whether or not platoon vehicles can pass through an intersection.

Outline of Embodiment of the Present Disclosure

Hereinafter, the outline of an embodiment of the present invention will be listed and described.

(1) An apparatus according to the present embodiment is configured to determine whether or not platoon vehicles can pass through an intersection, and the apparatus includes: a calculation unit configured to calculate a first distance, a second distance, and a third distance described below; and a determination unit configured to determine whether or not the platoon vehicles can pass through the intersection, based on a result of comparison of the first distance with the second and third distances.

First distance: a distance from a stop line of the intersection to a position of a leading vehicle at the present time.

Second distance: a distance obtained by subtracting a platoon length from a distance of traveling for a remaining green interval at a vehicle speed at the present time.

Third distance: a distance required for the leading vehicle to safely stop before the stop line of the intersection, with the vehicle speed at the present time.

The first distance corresponds to, for example, "platoon head position X" described below.

The second distance corresponds to, for example, "limit distance Ld" described below.

The third distance corresponds to, for example, "safe stop distance Bd" described later.

The "remaining green interval" used for calculation of the second distance is only the remaining green interval at the present time when passing the intersection with yellow light is not considered, whereas it is a time interval obtained by adding a yellow interval (e.g., 3 sec) in the next step to the remaining green interval at the present time when passing the intersection with yellow light is considered.

According to the passage possibility determination apparatus of the present embodiment, since the determination unit determines whether or not the platoon vehicles can pass through the intersection, based on the result of comparison of the first distance with the second and third distances, it becomes possible to appropriately determine whether or not the platoon vehicles can pass through the intersection (whether the platoon vehicles should pass through the intersection or stop before the stop line), as compared to the case where passage possibility is determined based on only the comparison result between the first distance and the second distance.

(2) In the passage possibility determination apparatus of the present embodiment, when the first distance is equal to or smaller than the second distance ($X \leq Ld$), the determination unit preferably determines that the platoon vehicles can pass through the intersection.

The reason is as follows. When the first distance is equal to or smaller than the second distance, the tail-end vehicle can pass through the intersection without further extension of the remaining green interval at the present time. Therefore, it is allowable to determine that the platoon vehicles can pass through the intersection.

(3) In the passage possibility determination apparatus of the present embodiment, when the first distance is equal to the third distance ($X=Bd$), the determination unit preferably determines whether or not the platoon vehicles can pass through the intersection, according to whether or not the remaining green interval at the intersection can be extended.

The reason is as follows. When the first distance is equal to the third distance, the leading vehicle is located at a position that allows safe stop of the leading vehicle before the intersection. Therefore, the leading vehicle may pass through the intersection if extension of the remaining green interval is possible, or may stop if extension of the remaining green interval is not possible.

(4) Therefore, when the first distance is equal to the third distance ($X=Bd$), the determination unit may determine that the platoon vehicles can pass through the intersection if the remaining green interval at the intersection can be extended, and may determine that the platoon vehicles cannot pass through the intersection if the remaining green interval at the intersection cannot be extended.

(5) In the passage possibility determination apparatus of the present embodiment, when the first distance is greater than the second distance ($X>Ld$) and the first distance is greater than the third distance ($X>Bd$), the determination unit preferably generates an extension request in which a time obtained by dividing the total of the first distance and the platoon length by the vehicle speed at the present time is an extension time for the remaining green interval to be applied to the intersection.

The reason is as follows. When the first distance is greater than the third distance, the leading vehicle is located sufficiently away from the intersection, and the driver of the leading vehicle is less likely to decelerate. Therefore, it is enough to extend the green interval by a time that allows the tail-end vehicle to pass the stop line of the intersection.

(6) In the passage possibility determination apparatus of the present embodiment, when the first distance is greater than the second distance ($X>Ld$) and the first distance is equal to the third distance ($X=Bd$), the determination unit preferably generates an extension request in which a time obtained by dividing the total of the third distance and the platoon length by the vehicle speed at the present time is an extension time for the remaining green interval to be applied to the intersection.

The reason is as follows. When the first distance is equal to the third distance, the leading vehicle is located near the intersection, and the driver of the leading vehicle is more likely to decelerate. Therefore, passing of the tail-end vehicle through the intersection should be made more reliable by extending the green interval more than an extent that allows the tail-end vehicle to pass the stop line of the intersection.

(7) In the passage possibility determination apparatus of the present embodiment, the calculation unit may adopt, as the third distance, Bd that is calculated by, for example, the following equation:

$$Bd=\tau \times Ve+Ve^2/(2\times De)$$

where $\tau$ is a driver's reaction time, De is preset deceleration of the platoon vehicles, and Ve is the vehicle speed at the present time.

(8) The passage possibility determination apparatus of the present embodiment preferably further includes a communication unit configured to notify the leading vehicle of a determination result of the determination unit.

Thus, the driver of the leading vehicle can perceive whether the tail-end vehicle of the platoon vehicles can pass through the intersection, or whether the driver should stop at the stop line, in advance before the intersection.

(9) A passage possibility determination method according to the present embodiment is a determination method executed by the passage possibility determination apparatus according to the above (1) to (8).

Therefore, the passage possibility determination method according to the present embodiment exhibits effects similar to those of the passage possibility determination apparatus according to the above (1) to (8).

(10) A first computer program according to the present embodiment is a program that causes a computer to function as the passage possibility determination apparatus according to the above (1) to (8).

Therefore, the computer program according to the present embodiment exhibits effects similar to those of the passage possibility determination apparatus according to the above (1) to (8).

Details of Embodiment of the Present Disclosure

Hereinafter, an embodiment of the present disclosure will be described in detail with reference to the drawings. At least some parts of the embodiment described below may be combined as desired.

In the present embodiment, light colors of signal light units comply with Japanese laws. Therefore, the light colors of the signal light units include green (in actuality, blue green), yellow, and red.

Green means that a vehicle can go straight ahead, turn left, and turn right at an intersection. Yellow means that a vehicle should not advance over a stop position (excluding a case where the vehicle cannot safely stop at the stop position). Red means that a vehicle should not advance over a stop position.

Therefore, green is a light color indicating that a vehicle traveling on an inflow road of an intersection has right-of-way at the intersection. Red is a light color indicating that the vehicle traveling on the inflow road of the intersection does not have right-of-way at the intersection. Yellow is a light color indicating that the vehicle does not have right-of-way in principle, but has right-of-way only when the vehicle cannot safely stop at the stop position.

(Overall Configuration of System)

FIG. 1 is a road plan view showing the overall configuration of a traffic signal control system according to the present embodiment.

As shown in FIG. 1, the traffic signal control system of the present embodiment includes a traffic signal controller 1, signal light units 2, roadside communication apparatuses 3, a central apparatus 4, on-vehicle devices 6 mounted on vehicles 5, etc.

The vehicles 5 include platoon vehicles 5P consisting of a plurality of (four in the example of FIG. 1) vehicles 5A to 5D traveling in platoon with a short inter-vehicle distance.

The vehicles 5A to 5D are not limited to large vehicles such as trucks and buses, and may be passenger cars such as taxies. The platoon vehicles 5P may be a combination of different types of vehicles 5A to 5D.

The following vehicles 5B and 5C can follow the preceding vehicles with a strict inter-vehicle distance according to CACC (Cooperative Adaptive Cruise Control).

In the present embodiment, it is assumed that the leading vehicle 5A of the platoon vehicles 5P is a manned vehicle while the following vehicles 5B to 5D are unmanned vehicles. However, the following vehicles 5B to 5D may be manned vehicles.

The traffic signal controller 1 is connected to a plurality of signal light units 2 installed at an intersection J via power lines. The traffic signal controller 1 is connected to the central apparatus 4 installed in a traffic control center or the like via a dedicated communication line.

The central apparatus 4 constructs a local area network with traffic signal controllers 1 installed at a plurality of intersections J within an area that the central apparatus 4 covers. Therefore, the central apparatus 4 is communicable with a plurality of traffic signal controllers 1, and each traffic signal controller 1 is communicable with the controllers 1 at other intersections J.

The central apparatus 4 receives, in each predetermined cycle (e.g., 1 min), sensor information measured by roadside sensors such as vehicle detectors and image sensors (not shown), and calculates, in each predetermined cycle (e.g., 2.5 min), a traffic index such as link travel time, based on the received sensor information.

The central apparatus 4 can perform traffic actuated control in which signal control parameters (split, cycle length, offset, and the like) at each intersection J are adjusted based on the calculated traffic index.

The central apparatus 4 can execute, for the traffic signal controllers 1 that belong to its coverage area, a coordinated control of adjusting offsets of a plurality of intersections J included in a coordinated section, and a wide-area control (area traffic control) in which the coordinated control is expanded onto a road network, for example.

The central apparatus 4 may notify the traffic signal controllers in its coverage area of control type information including whether or not local actuated control at a specific intersection J is permitted.

When identification information that permits the local actuated control is included in the control type information received from the central apparatus 4, the traffic signal controller 1 executes a predetermined local actuated control such as PTPS (Public Transportation Priority System) for the intersection J in charge of the controller 1.

Based on the signal control parameters received from the central apparatus 4, the traffic signal controller 1 controls turn-on, turn-off, blinking, etc., of the signal light units 2. When executing the local actuated control, the traffic signal controller 1 can switch the light colors of the signal light units 2 according to the result of the control.

The traffic signal controller 1 is connected to the roadside communication apparatus 3 via a predetermined communication line. Therefore, the traffic signal controller 1 also functions as a relay device for communication between the central apparatus 4 and the roadside communication apparatus 3.

The roadside communication apparatus 3 is a middle-to-wide range wireless communication device based on a predetermined communication standard such as ITS (Intelligent Transport Systems) wireless system, wireless LAN, or LTE (Long Term Evolution). Therefore, the roadside communication apparatus 3 is wirelessly communicable with the on-vehicle devices 6 of the vehicles 5 traveling on the road.

The roadside communication apparatus 3 wirelessly transmits downlink information to the on-vehicle devices 6. The roadside communication apparatus 3 can include, in the downlink information, traffic jam information generated by the central apparatus 4, traffic signal information (signal light color switching information) generated by the traffic signal controller 1, etc.

Each on-vehicle device 6 receives the downlink information from the roadside communication apparatus 3 when the on-vehicle device 6 enters a communication area of the roadside communication apparatus 3 (e.g., an area within about 300 m upstream from the intersection J).

The on-vehicle device 6 transmits uplink information to the roadside communication apparatus 3 in a predetermined transmission cycle (e.g., 100 ms). The uplink information includes, for example, probe data indicating the travel locus of the vehicle 5. The probe data includes vehicle ID, data generation time, vehicle position, vehicle speed, vehicle heading, etc.

The roadside communication apparatus 3 can also include, in the downlink information, a message regarding whether or not passing of the platoon vehicles 5P through the intersection J is possible, as provision information directed to the platoon vehicles 5P. In the present embodiment, the central apparatus 4 generates the message regarding whether or not passing is possible.

The probe data transmitted from the on-vehicle device 6 of the platoon vehicles 5P includes vehicle ID, vehicle speed, and vehicle heading of the leading vehicle 5A, platoon head position (position of the front end of the leading vehicle 5A), platoon length, planned traveling route, preset deceleration (constant), etc.

The platoon length is, for example, the length from the platoon head position (position of the front end of the leading vehicle 5A) to a platoon tail position (position of the rear end of the tail-end vehicle 5D). The platoon length may be the length from the platoon head position to the position of the front end of the tail-end vehicle 5D.

The on-vehicle device 6 of the leading vehicle 5A specifies the number of vehicles (four in FIG. 1) included in the platoon vehicles 5P, based on the number of the following vehicles 5B to 5D that perform vehicle-to-vehicle communication with the vehicle 5A, and calculates the platoon length based on the specified number of vehicles, the length of each vehicle, and the inter-vehicle distance. The on-vehicle device 6 includes the value of the calculated platoon length in the probe data.

The planned traveling route is information indicating which route the platoon vehicles 5P will take after having passed through the intersection J. The planned traveling route is, for example, identification information of a road link connected to the intersection J.

The on-vehicle device 6 of the leading vehicle 5A performs map matching of a planned traveling path calculated by a navigation device (not shown) of the leading vehicle 5A, with road map data, to identify the road link after passing through the intersection J, and includes identification information of the road link in the probe data.

The preset deceleration is a representative value (e.g., average value) of deceleration from when a brake starts to work to when the vehicle 5 safely stops. Generally, the heavier the vehicle 5 is, the harder it is for the vehicle 5 to smoothly come to a stop.

Therefore, when the vehicles included in the platoon vehicles 5P are cargo vehicles such as trucks, different values of preset decelerations may be adopted according to the loads thereof. In this case, for example, the value of preset deceleration may be gradually decreased for a vehicle that is heavily loaded.

[Structure of Traffic Signal Controller]

Figure 2:
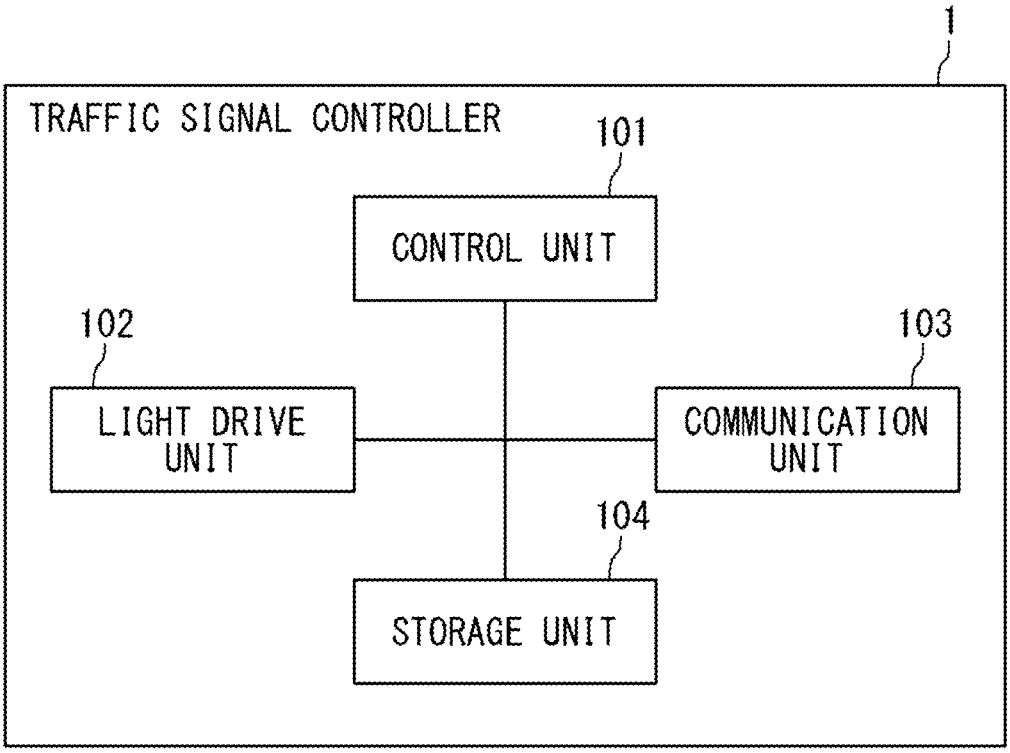
FIG. 2 is a block diagram showing an example of an internal structure of a traffic signal controller.

FIG. 2 is a block diagram showing an example of an internal structure of the traffic signal controller 1.

As shown in FIG. 2, the traffic signal controller 1 includes a control unit 101, a light drive unit 102, a communication unit 103, and storage unit 104.

The control unit 101 is implemented by one or a plurality of microcomputers, and is connected to the light drive unit 102, the communication unit 103, and the storage unit 104 via an internal bus. The control unit 101 controls the operations of these hardware units.

The control unit 101 usually determines a light color switching timing of each signal light unit 2 in accordance with the signal control parameters that are determined by the central apparatus 4 based on the traffic actuated control.

When the local actuated control is permitted by the control type information from the central apparatus 4, the control unit 101 may determine a light color switching timing of each signal light unit 2 in accordance with the result of the local actuated control performed in the traffic signal controller 1.

The light drive unit 102 includes a semiconductor relay (not shown), and turns on/off an AC voltage (AC 100 V) or a DC voltage that is supplied to each of signal lights of the signal light unit 2, based on the signal switching timing determined by the control unit 101.

The communication unit 103 is a communication interface that performs wired communication with the central apparatus 4 and the roadside communication apparatus 3. Upon receiving the signal control parameters from the central apparatus 4, the communication unit 103 transmits the parameters to the control unit 101. Upon receiving the provision information directed to vehicles from the central apparatus 4, the communication unit 103 transmits the provision information to the roadside communication apparatus 3.

The communication unit 103 receives the probe data of the vehicles 5 including the platoon vehicles 5P from the roadside communication apparatus 3 almost in real time (e.g., at intervals of 0.1 to 1.0 sec).

The storage unit 104 is implemented by a storage medium such as a hard disk or a semiconductor memory. The storage unit 104 temporarily stores therein various kinds of information (signal control parameters, probe data, etc.) received by the communication unit 103.

The storage unit 104 also stores therein a computer program that allows the control unit 101 to realize local actuated control, etc.

[Structure of Central Apparatus]

Figure 3:
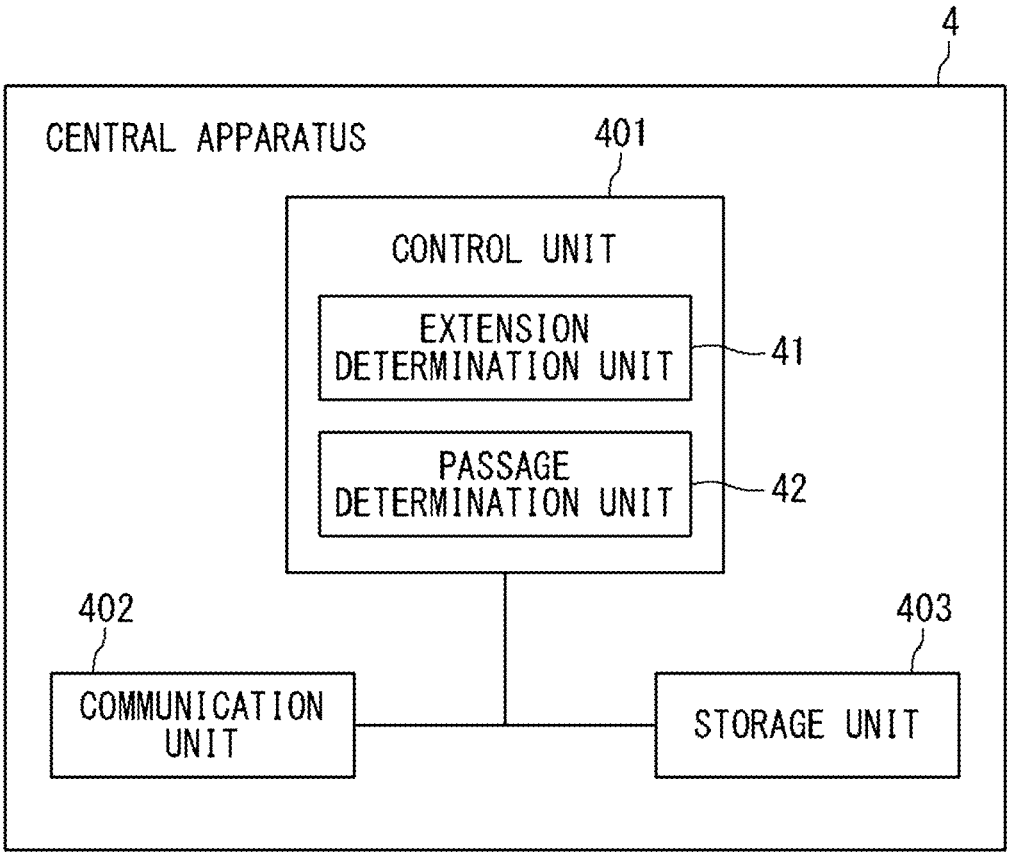
FIG. 3 is a block diagram showing an example of an internal structure of a central apparatus.

FIG. 3 is a block diagram showing an example of the internal structure of the central apparatus 4.

As shown in FIG. 3, the central apparatus 4 includes a control unit 401, a communication unit (acquisition unit) 402, and a storage unit 403.

The control unit 401 is implemented by a work station (WS), a personal computer (PC), or the like. The control unit 401 collects various kinds of information from the traffic signal controller 1 and the roadside communication apparatus 3, processes (operates) and stores the information, and comprehensively performs signal control, information provision, etc.

The control unit 401 is connected to the aforementioned hardware units via an internal bus, and controls the operations of these units.

The communication unit 402 is a communication interface that is connected to the LAN side via a communication line. The communication unit 402 transmits the signal control parameters of the signal light units 2 at the intersection J to the traffic signal controller 1 in each predetermined cycle (e.g., 1.0 to 2.5 min).

The communication unit 402 receives, from the traffic signal controller 1, the probe data which is acquired by the roadside communication apparatus 3 and is necessary for traffic actuated control (central actuated control) to be performed by the central apparatus 4. The communication unit 402 transmits the signal control parameters, the control type information, etc., to the traffic signal controller 1.

In the example of FIG. 1, the communication unit 402 of the central apparatus 4 receives, via the traffic signal controller 1, the probe data that is uplink-transmitted from the roadside communication apparatus 3. However, the communication unit 402 may receive the probe data through direct communication with the roadside communication apparatus 3.

The communication unit 402 functions as an acquisition unit for acquiring information (platoon length, planned traveling route, etc.) necessary for generating provision information to the platoon vehicles 5P.

Figure 8:
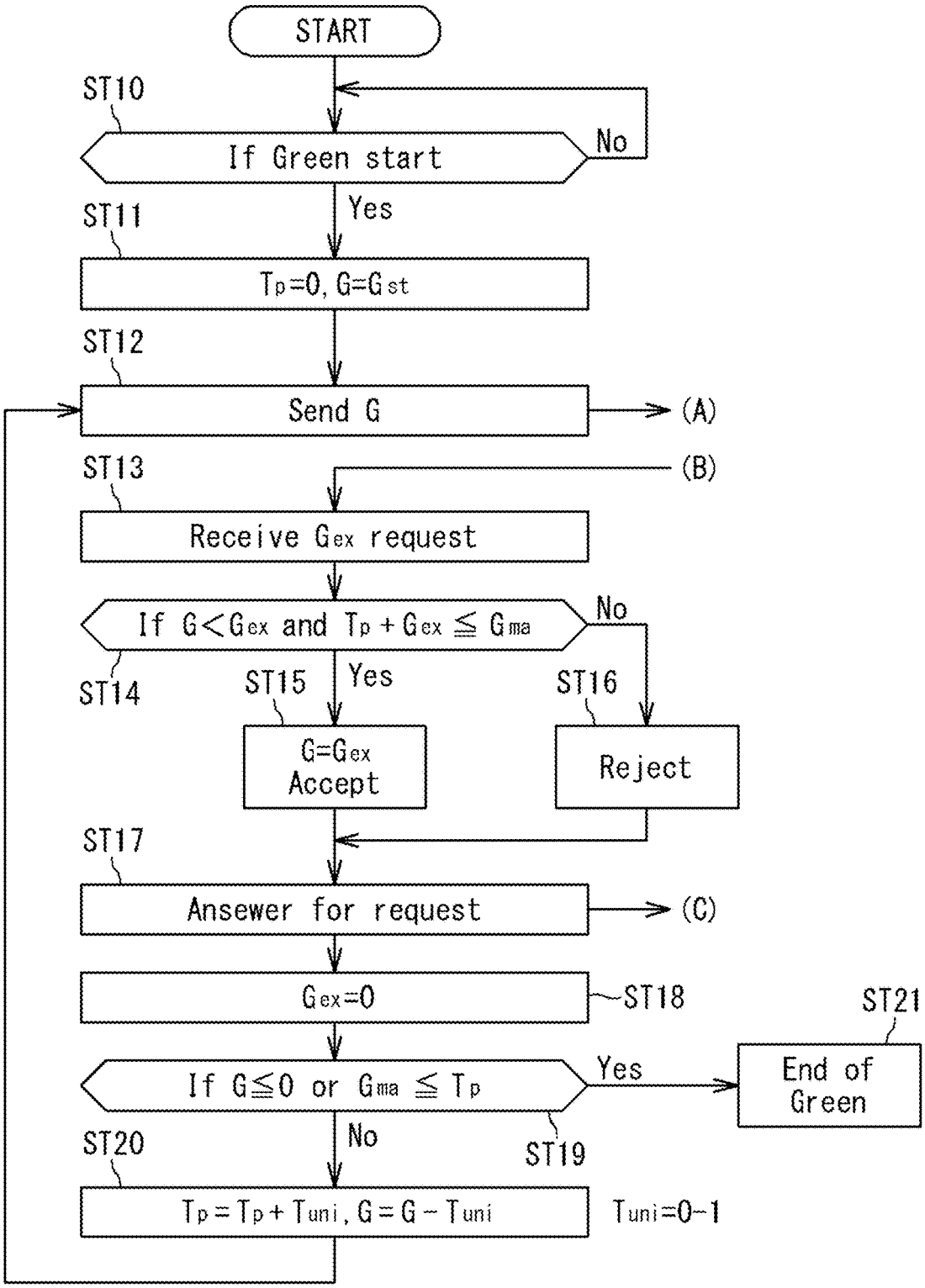
FIG. 8 is a flowchart showing an example of an extension possibility determination process by an extension determination unit.
Figure 9:
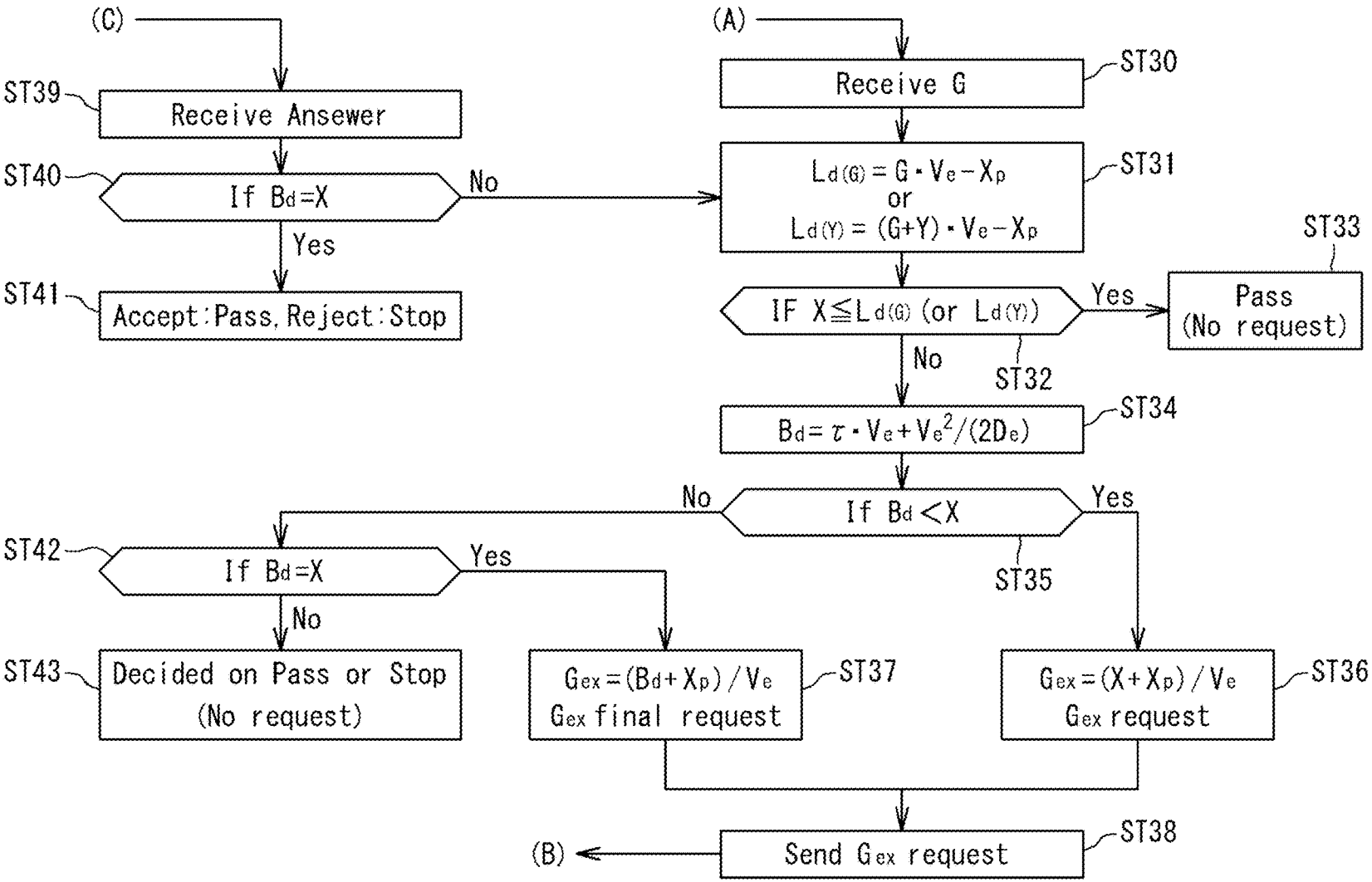
FIG. 9 is a flowchart showing an example of the passage possibility determination process by the passage determination unit.

The storage unit 403 is implemented by a hard disk, a semiconductor memory, or the like, and stores therein a computer program that executes a determination process described below (FIG. 8 and FIG. 9).

The storage unit 403 stores therein information necessary for execution of preferential control for platoon, such as step information including signal light colors for steps and the number of seconds for each step, and the position of the intersection J.

The storage unit 403 temporarily stores therein the signal control parameters generated by the control unit 401, the probe data received from the roadside communication apparatus 3, etc.

As shown in FIG. 3, the control unit 401 includes an "extension determination unit 41" and a "passage determination unit 42" as function units implemented by executing the computer program.

The extension determination unit 41 is a function unit that determines whether or not extension of a green interval for the platoon vehicles 5P can be executed. The passage determination unit 42 is a function unit that determines whether or not the platoon vehicles 5P can pass through the intersection J, based on the position of the leading vehicle at the present time, the vehicle speed, the remaining green interval, etc. Hereinafter, the contents of controls executed by these units 41, 42 will be described.

[Outline of Passage Possibility Determination Process]

Figure 4:
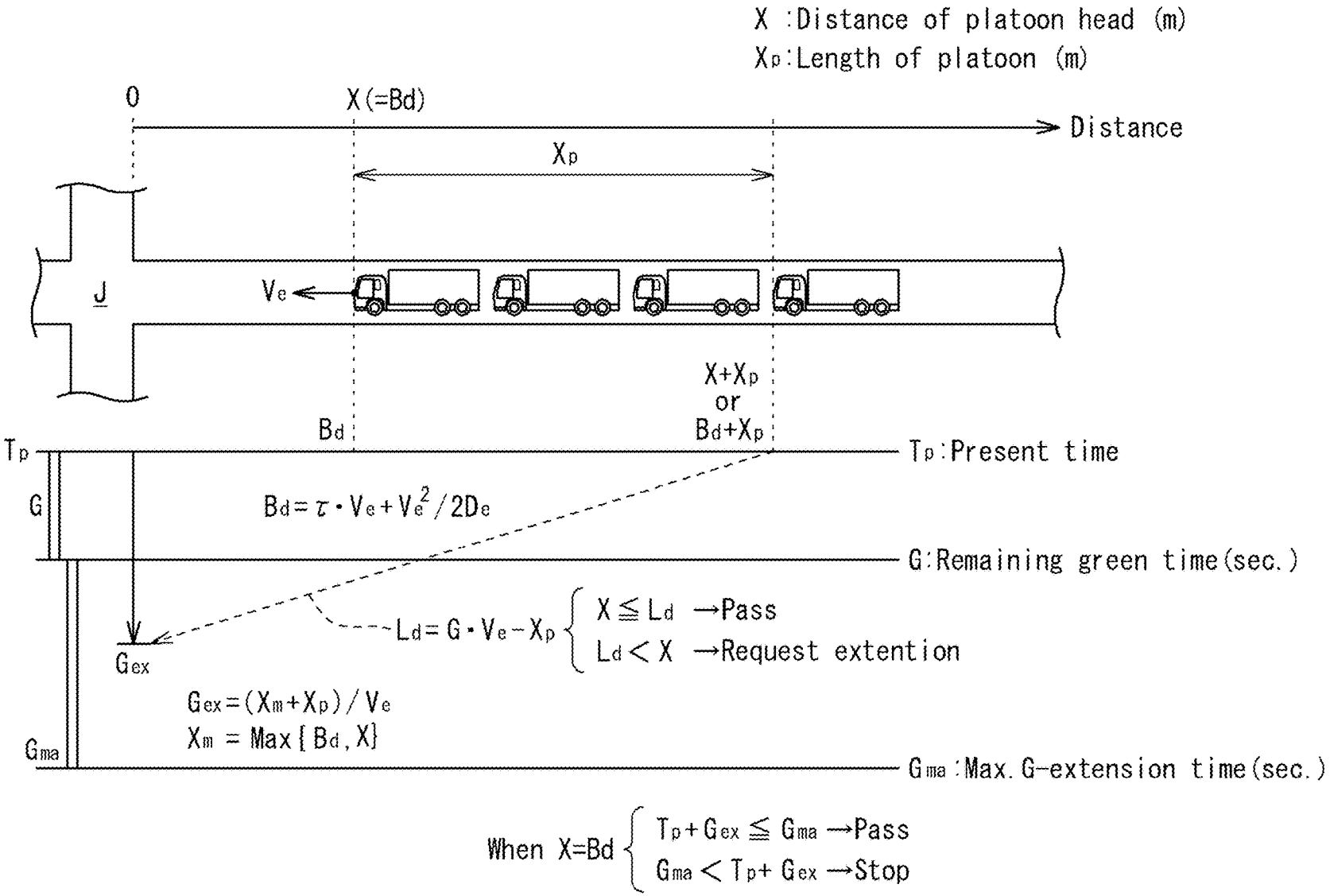
FIG. 4 illustrates an outline of a passage possibility determination process by a passage determination unit.

FIG. 4 illustrates the outline of a passage possibility determination process performed by the passage determination unit 42.

As shown in FIG. 4, in the present embodiment, the position of the platoon vehicles 5P on the inflow road is defined by distance coordinates that have a stop line of the intersection J as an origin point and that is positive in an upstream direction. Hereinafter, parameters shown in FIG. 4 will be described along with their definitions.

X: the values of distance coordinates corresponding to the platoon head position (front end of the leading vehicle 5A). The platoon head position X indicates a distance from the stop line of the intersection J to the front end of the leading vehicle 5A at the present time.

Xp: a platoon length of the platoon vehicles 5P. In the present embodiment, the platoon length is the length of a platoon of three vehicles, excluding the vehicle length of the tail-end vehicle 5D. Therefore, Xp is a distance from the platoon head position X to the front end of the tail-end vehicle 5D. The platoon length may be defined by $\alpha \times Xp$, that is, by multiplying the actual length Xp by a predetermined margin $\alpha$ (<1).

Tp: the present time.

G: a variable indicating a remaining green interval at the present time.

Gma: a maximum value of an extendable green interval.

Gex: an extension time of the remaining green interval. Hereinafter, Gex is also referred to as "green extension time".

Ve: the vehicle speed of the platoon vehicles 5P at the present time.

Ld: a distance obtained by subtracting the platoon length Xp from a distance (=G×Ve) of traveling for the remaining green interval G at the present vehicle speed Ve. That is, Ld is calculated by the following equation. Hereinafter, Ld is also referred to as "limit distance".

$$Ld = G \times Ve - Xp$$

The limit distance Ld indicates a position at which the front end of the tail-end vehicle 5D will arrive when the remaining green interval G elapses, if the vehicle speed Ve at the present time is maintained.

Bd: a safe stop distance. The safe stop distance Bd is a distance that allows the leading vehicle 5A of the platoon vehicles 5P to safely stop before the stop line. The safe stop distance Bd is calculated by the following equation, for example.

$$Bd = \tau \times Ve + Ve^2/(2 \times De)$$

where $\tau$ is a driver's reaction time, and De is preset deceleration of the platoon vehicles 5P.

As shown in FIG. 4, in the passage possibility determination process performed by the passage determination unit 42, Xm=Max{Bd,X} is introduced, and an equation for calculating the green extension time Gex is defined as follows.

$$Gex = (Xm + Xp)/Ve$$

That is, when X>Bd, the calculation equation for the green extension time Gex is Gex=(X+Xp)/Ve. When X=Bd, the calculation equation for the green extension time Gex is Gex=(Bd+Xp)/Ve.

When X≤Ld, the tail-end vehicle 5D can pass through the intersection J with the present remaining green interval G. Therefore, the passage determination unit 42 determines that passing is possible (Pass) without requesting the extension determination unit 41 for extension of the green interval.

When X>Ld, although the tail-end vehicle 5D cannot pass through the intersection J with the present remaining green interval G, the tail-end vehicle 5D can pass through the intersection J if the remaining green interval G is extended. Therefore, the passage determination unit 42 requests the extension determination unit 41 for extension of the green interval, which allows the tail-end vehicle 5D to pass through the intersection J, and determines whether or not passing is possible, according to the determination result of the extension determination unit 41.

If the extension determination unit 41 permits extension of the green interval because Tp+Gex≤Gma when X=Bd, since this extension allows the tail-end vehicle 5D to pass through the intersection J, the passage determination unit 42 determines that the tail-end vehicle 5D can pass through the intersection J (Pass).

If the extension determination unit 41 rejects extension of the green interval because Gma<Tp+Gex when X=Bd, since the green interval is not extended and the tail-end vehicle 5D cannot pass through the intersection J, the passage determination unit 42 determines to stop the platoon vehicles 5P (Stop).

[Positional Relationship Between Platoon Head Position, Limit Distance, and Safe Stop Distance]

Figure 5:
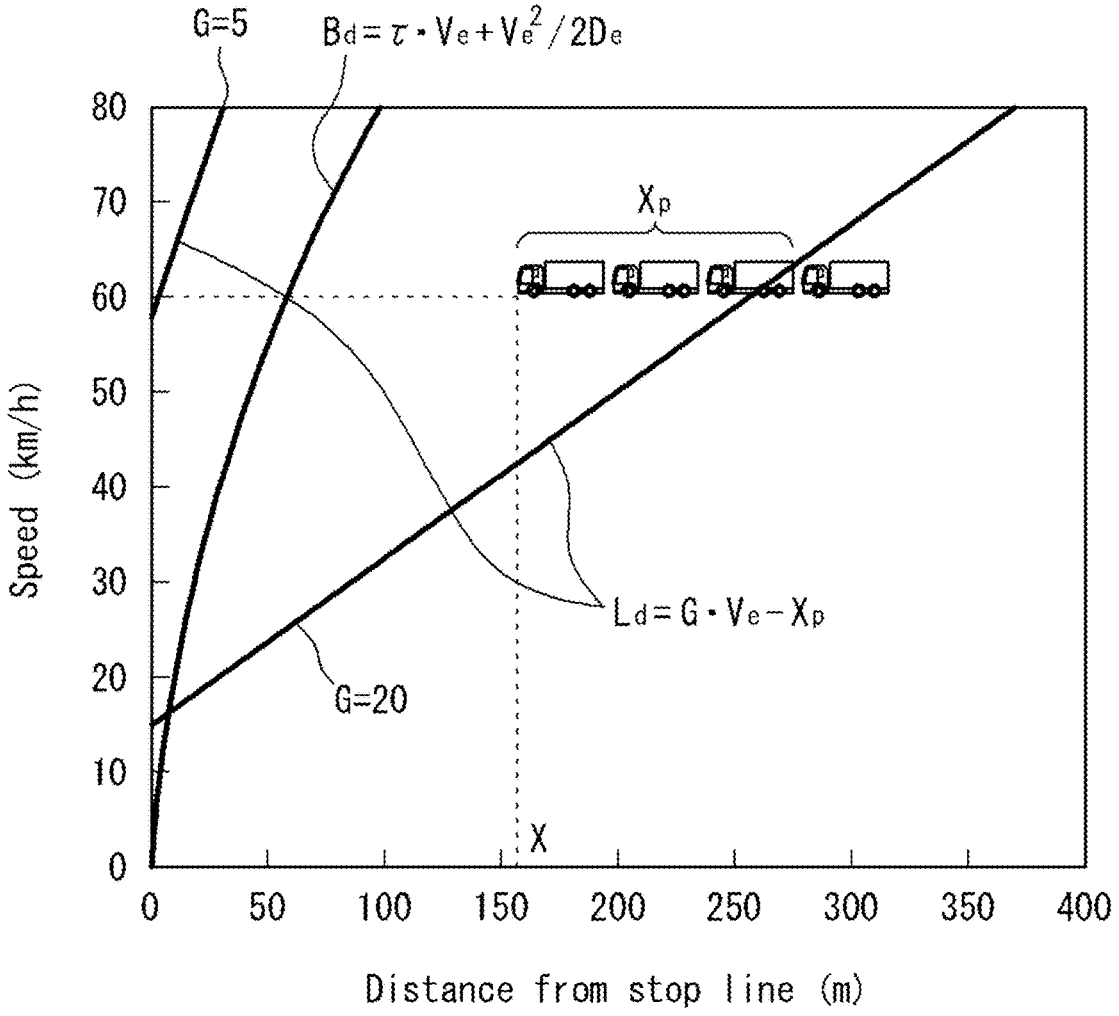
FIG. 5 is a graph showing an example of positional relationship between a platoon head position, a limit distance, and a safe stop distance.
Figure 6:
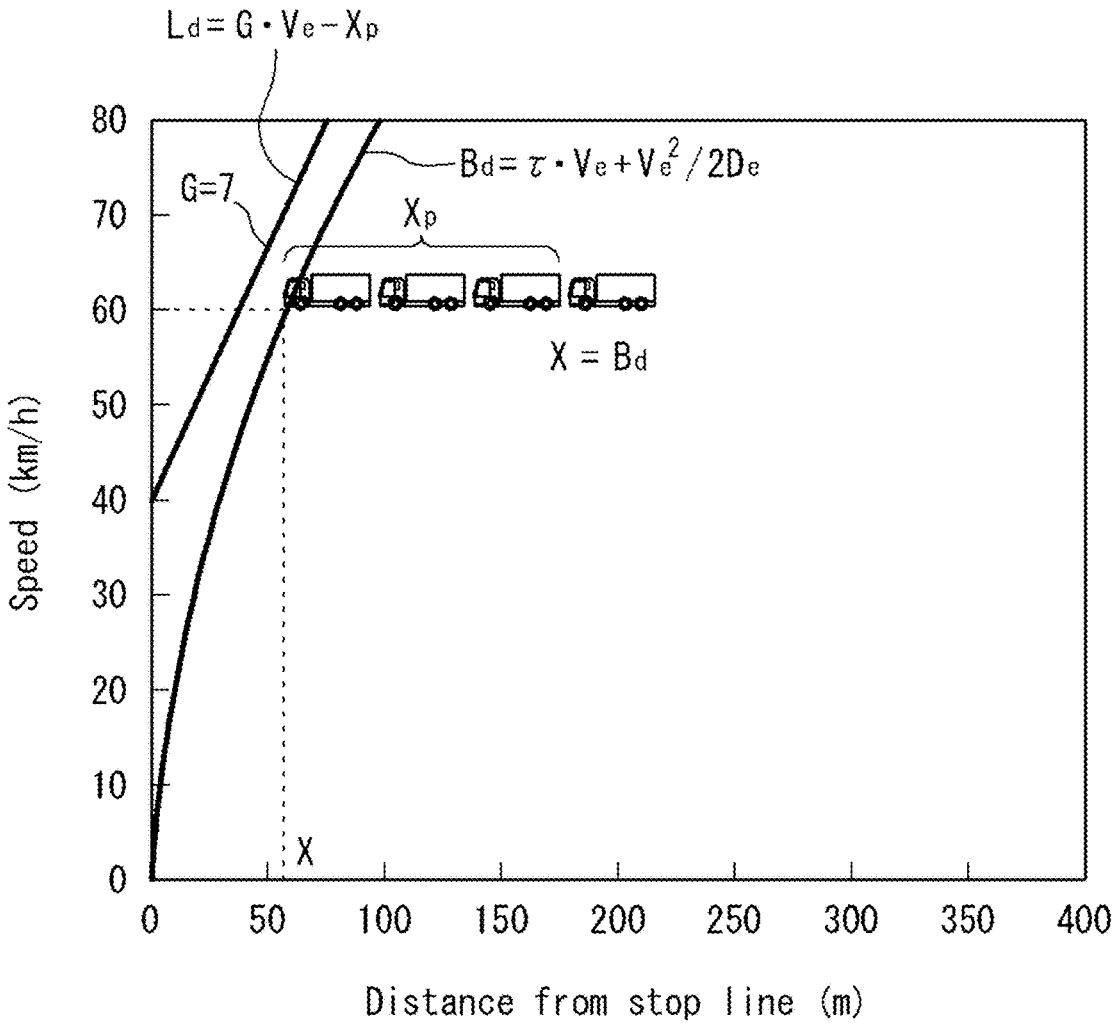
FIG. 6 is a graph showing an example of positional relationship between a platoon head position, a limit distance, and a safe stop distance.
Figure 7:
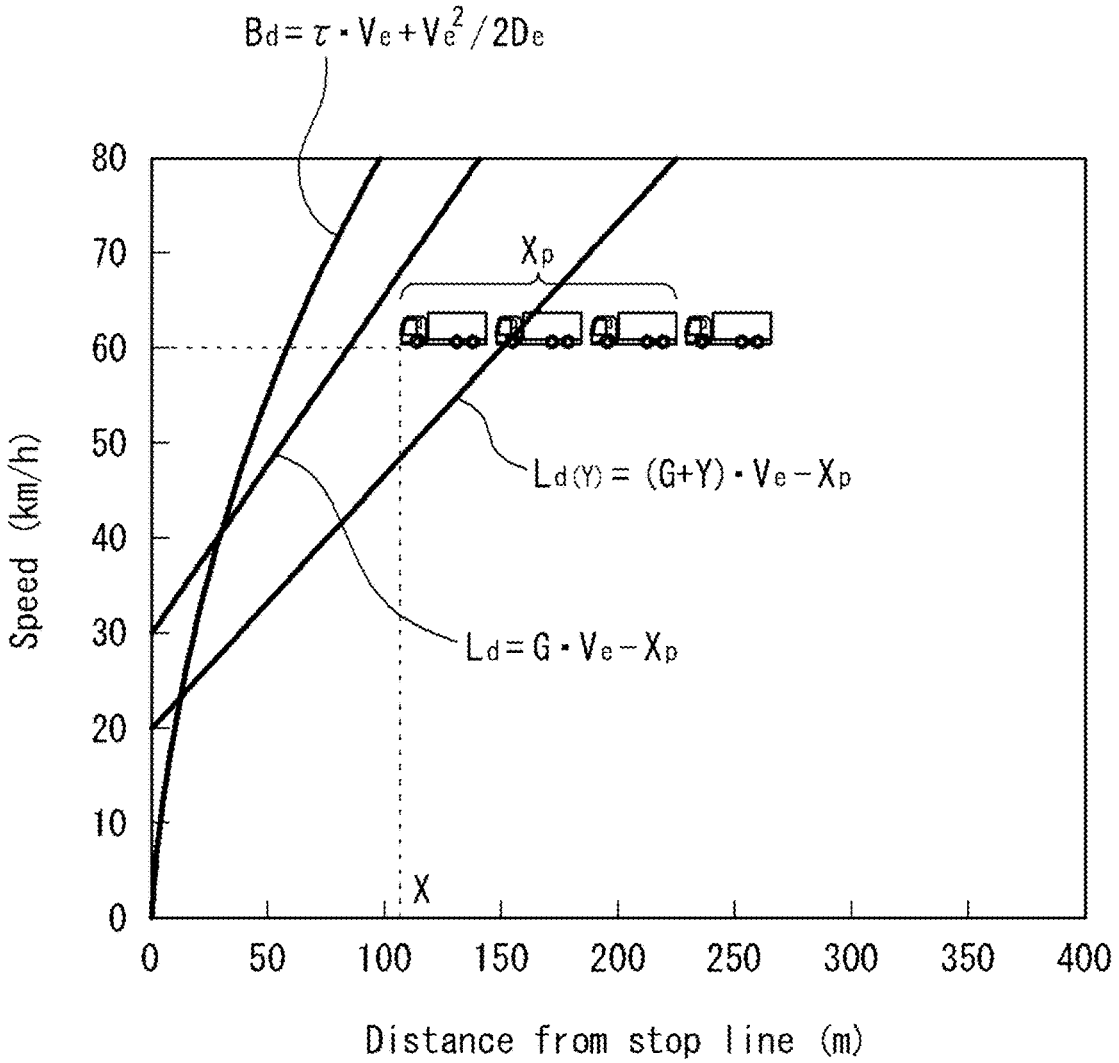
FIG. 7 is a graph showing an example of positional relationship between a platoon head position, a limit distance, and a safe stop distance.

FIG. 5 to FIG. 7 are graphs showing examples of the positional relationship between the platoon head position X, the limit distance Ld, and the safe stop distance Bd.

In FIG. 5 to FIG. 7, the horizontal axis indicates the distance from the stop line of the intersection J, and the vertical axis indicates the vehicle speed of the platoon vehicles 5P.

In FIG. 5, the vehicle speed of the platoon vehicles 5P is 60 km/h, the platoon head position X is about 155 m, and X>Bd.

In FIG. 5, since X≤Ld when G=20, passing through the intersection J is possible (Pass). Therefore, the tail-end vehicle 5D can pass the stop line of the intersection J without extending the green interval.

Since X>Ld when G=5, passing through the intersection J is not possible (Stop). Therefore, the tail-end vehicle 5D cannot pass the stop line of the intersection J unless the remaining green interval G is extended.

In FIG. 6, the vehicle speed of the platoon vehicles 5P is km/h, the platoon head position X is about 55 m, and X=Bd.

In FIG. 6, since X>Ld when G=7, the tail-end vehicle 5D cannot pass the stop line of the intersection J unless the remaining green interval G is extended. In addition, since X=Bd, if the remaining green interval G cannot be extended, the platoon head position X in FIG. 6 becomes the limit position for safe stop before the stop line of the intersection J.

In FIG. 7, the vehicle speed of the platoon vehicles 5P is 60 km/h, the platoon head position X is about 105 m, and X>Bd.

In FIG. 7, two kinds of limit distances $Ld_{(G)}$ and $Ld_{(Y)}$ are shown. Thus, as for the limit distance Ld, not only $Ld_{(G)}$ (=G×Ve−Xp) considering only the remaining green interval G but also $Ld_{(G)}$ (=(G+Y)×Ve−Xp) considering the yellow interval Y as well, may be adopted.

In the example of FIG. 7, since $X \leq Ld_{(Y)}$, when $Ld_{(Y)}$ is adopted, the tail-end vehicle 5D can pass the stop line of the intersection J (Pass by Yellow) with the present remaining green interval G.

Meanwhile, since $X > Ld_{(G)}$, when $Ld_{(G)}$ is adopted, the tail-end vehicle 5D cannot pass the stop line of the intersection J with the current remaining green interval. Therefore, the platoon vehicles 5P need to be stopped before the stop line (Stop).

[Specific Example of Extension Possibility Determination Process]

FIG. 8 is a flowchart showing an example of an extension possibility determination process performed by the extension determination unit 41.

As shown in FIG. 8, on condition that green light starts (step ST10), the extension determination unit 41 sets the present time Tp to 0, and sets the remaining green interval G to a normal value Gst without extension (step ST11).

The extension determination unit 41 transmits the set remaining green interval G to the passage determination unit 42 (step ST12: (A)).

Upon receiving an extension request including the green extension time Gex from the passage determination unit 42 ((B): step ST13), the extension determination unit 41 determines whether or not the following two inequalities are satisfied.

$$G<Gex$$

$$Tp+Gex \leq Gma$$

When the determination result in step S14 is positive, the extension determination unit 41 sets the remaining green interval G to the green extension time Gex, and transmits a response including "extension accepted" (Accept) to the passage determination unit 42 (step ST15, ST17: (C)).

When the determination result in step S14 is negative, the extension determination unit 41 does not set the remaining green interval G to the green extension time Gex, and transmits a response message including "extension rejected" (Reject) to the passage determination unit 42 (step ST16, ST17: (C)).

Next, the extension determination unit 41 resets the green extension time Gex to 0 (step ST18), and determines whether or not either of the following two inequalities is satisfied (step ST19).

$$G \leq 0$$

$$Gma \leq Tp$$

When the determination result in step S19 is negative, the extension determination unit 41 adds a predetermined unit time Tuni to the present time Tp and subtracts the unit time Tuni from the remaining green interval G (step ST120), and returns the process to step ST12.

When the determination result in step S19 is positive, since the remaining green interval G has run out or the present time has reached the maximum green interval Gma, the green light is aborted (step ST21).

[Specific Example of Passage Possibility Determination Process]

FIG. 9 is a flowchart showing an example of the passage possibility determination process performed by the passage determination unit 42.

As shown in FIG. 9, upon receiving the remaining green interval G from the extension determination unit 41 ((A): step ST30), the passage determination unit 42 calculates a limit distance Ld based on either of the following equations (step ST31).

$$Ld_{(G)}=G \times Ve-Xp$$

$$Ld_{(Y)}=(G+Y) \times Ve-Xp$$

Next, the passage determination unit 42 determines whether or not the platoon head position X at the present time is equal to or smaller than the limit distance $Ld_{(G)}$ (or $Ld_{(Y)}$) (step ST32).

When the determination result in step ST32 is positive, the passage determination unit 42 determines that the tail-end vehicle 5D can pass the stop line of the intersection J without requesting the extension determination unit 41 for extension of the green interval (step ST33).

When the determination result in step ST32 is positive, the passage determination unit 42 calculates a safe stop distance Bd with the vehicle speed at the present time, according to the above calculation equation (step ST34).

Next, the passage determination unit 42 determines whether or not the calculated safe stop distance Bd is smaller than the platoon head position X at the present time (step ST35).

When the determination result in step ST35 is positive (X>Bd), the passage determination unit 42 calculates a green extension time Gex according to the following equation (step ST36), and transmits an extension request including the calculated Gex to the extension determination unit 41 (step ST38: (B)).

$$Gex=(X+Xp)/Ve$$

The reason is as follows. When X>Bd, the leading vehicle 5A is located sufficiently away from the intersection J, and the driver of the leading vehicle 5A is less likely to decelerate. Therefore, it is enough to extend the green interval only by a time that allows the tail-end vehicle 5D to pass the stop line of the intersection J.

When the determination result in step ST35 is negative (X≤Bd), the passage determination unit 42 further determines whether or not the safe stop distance Bd is equal to the platoon head position X at the present time (step ST42). The term "equal" does not mean "exactly equal". The distance Bd is determined to be equal to the position X when a difference between them is within a predetermined error range (e.g., ±30 cm).

When the determination result in step ST42 is positive (X=Bd), the passage determination unit 42 calculates a green extension time Gex according to the following equation (step ST37), and transmits a final extension request including the calculated Gex to the extension determination unit 41 (step ST38: (B)).

$$Gex=(Bd+Xp)/Ve$$

The reason is as follows. When X=Bd, the leading vehicle 5A is located near the intersection J, and the driver of the leading vehicle 5A is more likely to decelerate. Therefore, passing of the tail-end vehicle 5D through the intersection J should be made more reliable by extending the green interval more than an extent that allows the tail-end vehicle 5D to pass the stop line of the intersection J.

When the determination result in step ST42 is negative (X<Bd), the passage determination unit 42 ends the process without making a green interval extension request to the extension determination unit 41 (step ST43).

The reason is as follows. In the present embodiment, an extension request to the extension determination unit 41 is performed during a period before the platoon head position X becomes smaller than the safe stop distance Bd (i.e., period in which X>Bd) (step ST38), and whether passing is possible (Pass) or not (Stop) is determined according to the result of whether or not extension is possible when X=Bd (steps ST39 to ST41), as described later.

Upon receiving a response message from the extension determination unit 41 ((C): step ST39), the passage determination unit 42 determines whether or not the safe stop distance Bd is equal to the platoon head position X at the present time (step ST40). The term "equal" does not mean "exactly equal". The distance Bd is determined to be equal to the position X when a difference between them is within a predetermined error range (e.g., ±30 cm).

When the determination result in step ST40 is negative (X≠Bd), the passage determination unit 42 returns the process to step ST31.

When the determination result in step ST40 is positive (X=Bd), the passage determination unit 42 executes a predetermined process according to the type of the response message (step ST41).

Specifically, when the type of the response message is "extension accepted" (Accept), the passage determination unit 42 notifies the leading vehicle 5A that passing through the intersection J is possible. When the type of the response message is "extension rejected" (Reject), the passage determination unit 42 notifies the leading vehicle 5A to stop at the stop line of the intersection J.

The above notification to the leading vehicle 5A is executed by transmitting a communication frame including either "passing is possible" (Pass) or "stop at the stop line" (Stop), to the roadside communication apparatus 3.

The road side communication apparatus 3 downlink-transmits the received communication frame. Upon receiving the communication frame, the on-vehicle device 6 of the leading vehicle 5A notifies the driver of the content of the communication frame through a display device, a voice output device, or the like in the vehicle 5A.

Thus, the driver of the leading vehicle 5A can perceive whether the tail-end vehicle 5D of the platoon vehicles 5P can pass through the intersection J, or whether the driver should stop at the stop line, in advance before the intersection J.

[Modifications]

The embodiment (including modifications) disclosed herein is merely illustrative and not restrictive in all aspects. The scope of the present disclosure is not limited to the embodiment described above, and includes all changes which come within the scope of equivalency of configurations described in the claims.

In the above embodiment, the control unit 401 of the central apparatus 4 includes the extension determination unit 41 and the passage determination unit 42 (FIG. 3). However, any of other roadside apparatuses such as the traffic signal controller 1 and the road side communication apparatus 3 may be provided with the extension determination unit 41 and the passage determination unit 42.

That is, the "passage possibility determination apparatus" including the extension determination unit 41 and the passage determination unit 42 according to the present embodiment can be configured as any of the central apparatus 4, the traffic signal controller 1, and the road side communication apparatus 3.

The extension determination unit 41 and the passage determination unit 42 may be separately mounted on different apparatuses. For example, the extension determination unit 41 may be mounted on any of the central apparatus 4, the traffic signal controller 1, and the road side communication apparatus 3 which are roadside apparatuses, while the passage determination unit 42 may be mounted on the on-vehicle device 6.

In this case, the roadside apparatus and the on-vehicle device 6 of the platoon vehicles 5P traveling on the inflow road exchange necessary information through wireless communication, thereby performing the extension possibility determination process (FIG. 8) and the passage possibility determination process (FIG. 9) in a shared manner.

In the aforementioned embodiment, the traffic signal controller 1, the central apparatus 4, and the on-vehicle device 6 each may have a communication function based on the fifth generation mobile communication system (5G).

In this case, if the central apparatus 4 is an edge server that is lower in delay than a core server, delay in communication between the central apparatus 4 and the on-vehicle device 6 can be reduced. This allows the central apparatus 4 to execute, based on probe data, traffic signal control with improved real-time property.

REFERENCE SIGNS LIST

1 traffic signal controller (passage possibility determination apparatus)
2 signal light unit
3 road side communication apparatus (passage possibility determination apparatus)
4 central apparatus (passage possibility determination apparatus)
5 vehicle
5A leading vehicle
5B to 5D following vehicles
5P platoon vehicles
6 on-vehicle device (passage possibility determination apparatus)
41 extension determination unit

42 passage determination unit (calculation unit, determination unit)
101 control unit
102 light drive unit
103 communication unit
104 storage unit
401 control unit
402 communication unit
403 storage unit
X platoon head position (first distance)
Ld limit distance (second distance)
Bd safe stop distance (third distance)

The invention claimed is:

1. A passage possibility determination system comprising a computer configured to determine whether platoon vehicles can pass through an intersection, the computer performing the steps to:

calculate a first distance, a second distance, and a third distance, wherein the first distance is a distance from a stop line of the intersection to a position of a leading vehicle at a present time, the second distance is obtained by subtracting a platoon length from a distance of traveling for a remaining green interval at a vehicle speed at the present time, and the third distance is a distance required for the leading vehicle to safely stop before the stop line of the intersection, with the vehicle speed at the present time;

determine whether or not the platoon vehicles can pass through the intersection, based on a result of comparison of the first distance with the second and third distances;

when the first distance is greater than the second distance and the first distance is greater than the third distance, extend for an extension time for the remaining green interval of a green light of a signal light at the intersection; and when the first distance is greater than the second distance and the first distance is equal to the third distance, extend for an extension time for the remaining green interval of the green light of the signal light at the intersection.

2. The passage possibility determination system according to claim 1, wherein when the first distance is equal to or smaller than the second distance, determine that the platoon vehicles can pass through the intersection.

3. The passage possibility determination system according to claim 1, wherein when the first distance is equal to the third distance, determine whether the platoon vehicles can pass through the intersection, according to whether the remaining green interval of the green light of the signal light at the intersection can be extended.

4. The passage possibility determination system according to claim 3, wherein determine that the platoon vehicles can pass through the intersection, when the remaining green interval of the green light of the signal light at the intersection can be extended, and determine that the platoon vehicles cannot pass through the intersection, when the remaining green interval of the green light of the signal light at the intersection cannot be extended.

5. The passage possibility determination system according to claim 1, wherein when the first distance is greater than the second distance and the first distance is greater than the third distance, wherein the computer further including a step to:

generate an extension request in which a time obtained by dividing a total of the first distance and the platoon length by the vehicle speed at the present time is the extension time for the remaining green interval to be applied to the intersection.

6. The passage possibility determination system according to claim 1, wherein when the first distance is greater than the second distance and the first distance is equal to the third distance, wherein the computer further including a step to:

generate an extension request in which a time obtained by dividing a total of the third distance and the platoon length by the vehicle speed at the present time is the extension time for the remaining green interval to be applied to the intersection.

7. The passage possibility determination system according to claim 1, wherein the calculation unit adopts, as the third distance, Bd calculated by the following equation:

$$Bd=\tau\times Ve+Ve^2/(2\times De)$$

where $\tau$ is a driver's reaction time, De is preset deceleration of the platoon vehicles, and Ve is the vehicle speed at the present time.

8. The passage possibility determination system according to claim 1, wherein the computer further including at step to:

notify the leading vehicle of a determination result.

9. A passage possibility determination method for determining whether platoon vehicles can pass through an intersection, the method comprising:

calculating a first distance, a second distance, and a third distance, wherein the first distance is a distance from a stop line of the intersection to a position of a leading vehicle at a present time, the second distance is obtained by subtracting a platoon length from a distance of traveling for a remaining green interval at a vehicle speed at the present time, and the third distance is a distance required for the leading vehicle to safely stop before the stop line of the intersection, with the vehicle speed at the present time;

determining whether the platoon vehicles can pass through the intersection, based on a result of comparison of the first distance with the second and third distances;

when the first distance is greater than the second distance and the first distance is greater than the third distance, extending for an extension time for the remaining green interval of a green light of a signal light at the intersection; and when the first distance is greater than the second distance and the first distance is equal to the third distance, extending for an extension time for the remaining green interval of the green light of the signal light at the intersection.

10. A non-transitory computer readable storage medium storing a computer program configured to cause a computer to determined whether platoon vehicles can pass through an intersection, the computer program causing the computer to:

calculate a first distance, a second distance, and a third distance, wherein the first distance is a distance from a stop line of the intersection to a position of a leading vehicle at a present time, the second distance is a distance obtained by subtracting a platoon length from a distance of traveling for a remaining green interval at a vehicle speed at the present time, and the third distance is a distance required for the leading vehicle to safely stop before the stop line of the intersection, with the vehicle speed at the present time;

determine whether the platoon vehicles can pass through the intersection, based on a result of comparison of the first distance with the second and third distances;

when the first distance is greater than the second distance and the first distance is greater than the third distance, extend for an extension time for the remaining green interval of a green light of a signal light at the intersection; and when the first distance is greater than the second distance and the first distance is equal to the third distance, extend for an extension time for the remaining green interval of the green light of the signal light at the intersection.

* * * * *